US006170477B1

(12) United States Patent
Horlock

(10) Patent No.: US 6,170,477 B1
(45) Date of Patent: Jan. 9, 2001

(54) PNEUMATIC SPEAR GUN

(76) Inventor: Nicolas James Horlock, 8D Ferguson Street, Karratha, Western Australia (AU)

( * ) Notice: Under 35 U.S.C. 154(b), the term of this patent shall be extended for 0 days.

(21) Appl. No.: 09/257,460

(22) Filed: Feb. 25, 1999

(30) Foreign Application Priority Data

Feb. 26, 1998 (AU) ..... PP2045

(51) Int. Cl.[7] ..... F41B 11/00; F41C 9/06; F41F 3/00

(52) U.S. Cl. ..... 124/61; 124/69; 124/70; 124/74; 124/80; 42/1.14; 89/1.81

(58) Field of Search ..... 124/20.3, 69, 80, 124/26, 74, 22, 61, 56, 70, 71, 72, 85; 42/1.14; 89/1.81; 43/6

(56) References Cited

U.S. PATENT DOCUMENTS

| | | | | |
|---|---|---|---|---|
| 2,833,266 | * | 5/1958 | Mares | 124/74 |
| 3,109,419 | * | 11/1963 | Hayward | 124/74 |
| 3,354,572 | * | 11/1967 | Dean | 124/61 |
| 3,735,747 | * | 5/1973 | Barjavel | 124/74 |
| 3,780,720 | * | 12/1973 | Alderson | 124/74 |
| 4,019,480 | * | 4/1977 | Kenaio | 124/61 |
| 4,660,315 | * | 4/1987 | Ferro | 43/6 |
| 4,709,686 | * | 12/1987 | Taylor et al. | 124/67 |
| 4,771,758 | * | 9/1988 | Taylor et al. | 124/68 |
| 5,086,749 | * | 2/1992 | Ekstrom | 124/74 |
| 5,193,517 | * | 3/1993 | Taylor et al. | 124/67 |
| 5,699,780 | * | 12/1997 | Bissonnette | 124/69 |
| 5,996,709 | * | 12/1999 | Norris | 175/4.5 |

FOREIGN PATENT DOCUMENTS

| | | | |
|---|---|---|---|
| 2280873 | * | 4/1976 | (FR) . |
| 7403631 | * | 9/1975 | (NL) . |
| 2046267C1 | * | 10/1995 | (RU) . |
| 2072075C1 | * | 1/1997 | (RU) . |
| 2082933C1 | * | 6/1997 | (RU) . |
| 2092768C1 | * | 10/1997 | (RU) . |
| 823814 | * | 4/1981 | (SU) . |
| 1048296 | * | 10/1983 | (SU) . |
| 1799449A3 | * | 2/1993 | (SU) . |
| 8501659 | * | 9/1986 | (ZA) . |

* cited by examiner

*Primary Examiner*—Michael J. Carone
*Assistant Examiner*—Fredrick T. French, III
(74) *Attorney, Agent, or Firm*—Hogan & Hartson LLP

(57) ABSTRACT

A pneumatic spear gun (11) comprising a barrel (27) having an open end (33) through which a shaft (15) of a spear (13) can be received. A first piston (35) is slidingly and sealingly received in the barrel (27) for movement towards and away from a retracted position. A retaining means (41) is provided for releasably retaining the piston (35) in the retracted position. A source of compressible fluid such as air is contained in a reservoir (59) and is arranged to undergo compression upon movement of the piston (35) into the retracted position and to propel the piston along the barrel (27) from the retracted position upon release of the piston thereby to propel the spear (13). A control means is provided for selectively increasing the pressure of the compressible fluid for varying the propulsive force applied to the piston (35). The control means includes a cylinder (43) forming part of the resevoir (59) and having a second piston (45) slidingly and sealingly mounted therein. One side of the second piston (45) is exposed to the compressible fluid whereby movement of the second piston (45) along the cylinder (43) effects a volume reduction of the reservoir (59) to thereby an increase in the pressure of the propulsive fluid.

17 Claims, 6 Drawing Sheets

PNEUMATIC SPEAR GUN

BACKGROUND OF THE INVENTION

Spear guns are devices for propelling spears and are typically used under water as a weapon or for hunting purposes. Known spear guns use various mechanisms for propelling a spear, one of which is a pneumatic system in which air is compressed to provide the propulsive force. Spear guns which employ a pneumatic system for propelling a spear are commonly referred to as pneumatic spear guns.

A pneumatic spear gun includes a barrel into which the shaft of a spear to be propelled by the spear gun can be received. A piston is slidingly and sealingly received within the barrel. One side of the piston communicates with a supply of air which undergoes compression upon retraction of the piston when the shaft of a spear is introduced into the barrel. The compressed air provides a propulsive force for propelling the piston along the barrel so as to discharge the spear. The air is contained in a reservoir within the body of the spear gun and an inlet is provided for replenishing the air as necessary.

While pneumatic spear guns are satisfactory in operation, they do have a deficiency in that it is not possible to selectively vary the propulsive force which can be applied to the piston.

DISCLOSURE OF THE INVENTION

It would be advantageous to provide a pneumatic spear gun in which the propulsive force applied to a spear discharged by the spear gun can be selectively varied.

The present invention provides a spear gun comprising a barrel having an open end through which a shaft of a spear can be received, a first piston slidingly and sealingly received in the barrel for movement towards and away from a retracted position, a retaining means for releasably retaining the piston in the retracted position, a source of compressible fluid arranged to undergo compression upon movement of the piston into the retracted position and to propel the piston along the barrel from the retracted position upon release of the piston thereby to propel the spear, and control means for selectively increasing the pressure of the compressible fluid for varying the propulsive force applied to the piston.

The control means may comprise means for effecting a volume reduction of the compressible fluid.

The compressible fluid may be contained in a reservoir and the means for effecting a volume reduction of the compressible fluid may comprise a wall of the reservoir movable to reduce the volume of the reservoir.

The reservoir may comprise a cylinder having a second piston slidingly and sealingly mounted therein to define the movable wall, one side of the second piston being exposed to the compressible fluid whereby movement of the second piston along the cylinder effects a variation of the volume of the reservoir, and wherein a second control means is provided for controlling movement of the second piston along the cylinder.

The second control means may comprise means for applying fluid pressure to the other side of the second piston. In this regard, the second control means may comprise a pump means for delivering the fluid pressure by way of an incompressible fluid.

Conveniently, the incompressible fluid comprises water received from an underwater environment in which the spear gun is being used.

Conveniently, the pump means comprises a hand operable pump.

The cylinder may be of annular configuration in cross-section and positioned around at least part of the barrel, with porting means providing for communication of the compressible fluid between the cylinder and the barrel.

The pump means may comprise a piston pump having a suction stroke and a delivery stroke.

The piston pump may comprise a pump piston slidingly and sealingly mounted in a pump cylinder, the pump piston and pump cylinder co-operating to define a pumping chamber, the pump piston including a sealing element movable axially between first and second positions upon a reciprocatory movement of the pump piston in the pump cylinder whereby upon a suction stroke of the piston the sealing element assumes the first position in which fluid can flow past the piston into the pumping chamber and upon a delivery stroke of the piston the sealing element assumes the second position in which the sealing element seals against fluid flow past the piston.

An intake path may be provided in the piston along which fluid can flow when the sealing element is in the first position.

Conveniently, the sealing element comprises an O-ring mounted on the piston body.

BRIEF DESCRIPTION OF THE DRAWINGS

The invention will be better understood by reference to the following description of one specific embodiment thereof as shown in the accompanying drawings in which.

BEST MODE OF PERFORMING THE INVENTION

Figure 1:
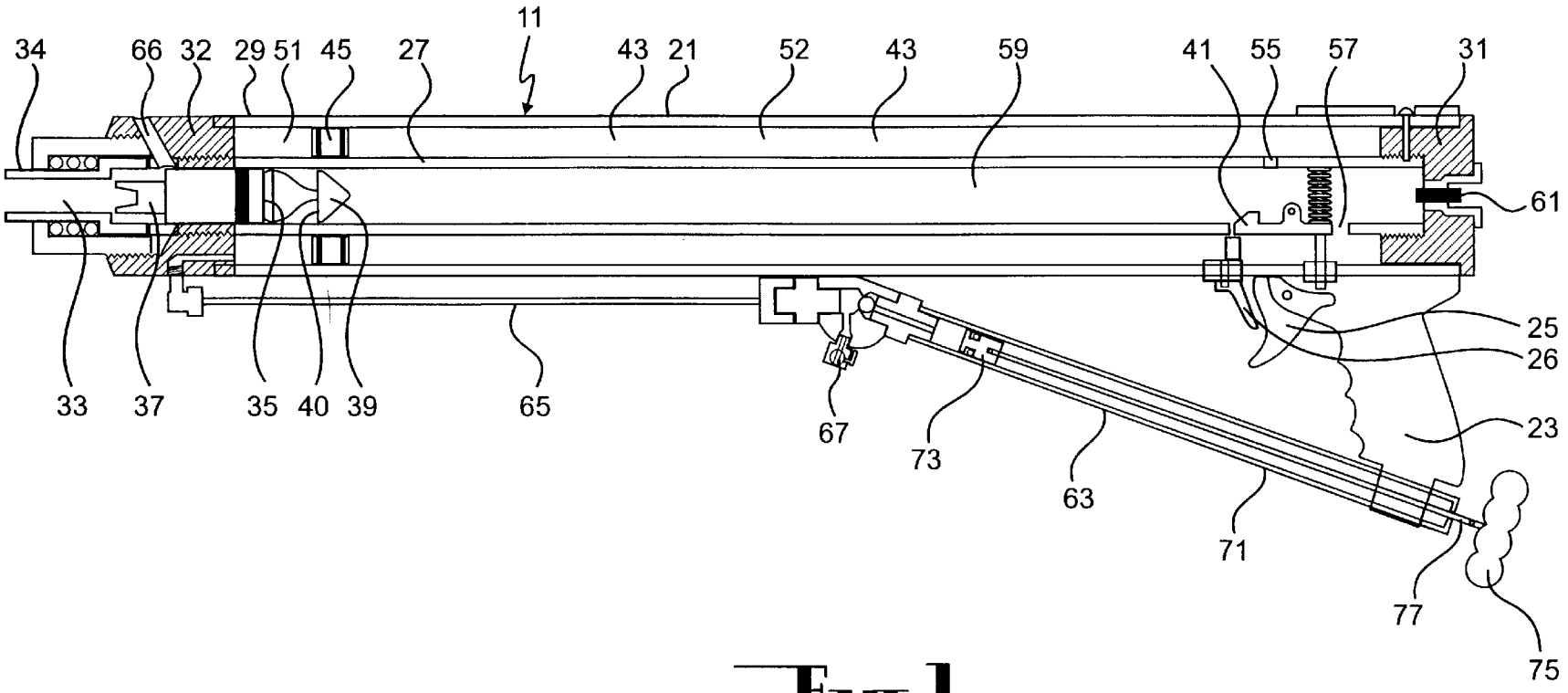
FIG. 1 is a sectional side elevational view of a spear gun according to the embodiment.

Referring to the drawings, there is shown a pneumatic spear gun 11 for propelling a spear 13 which includes a shaft 15 having an inwardly tapered trailing end 17.

The spear gun 11 comprises a body 21 and a handle 23 of the pistol-grip type. A trigger mechanism 25 is associated with the handle 23 for firing the spear gun, as will be explained in more detail later. A safety mechanism 26 is provided to prevent accidental discharge of the spear gun.

The body 21 includes a barrel 27 of circular cross-section and a cylindrical sleeve positioned around the barrel 27 in spaced apart relationship therewith.

The barrel 27 and the cylindrical sleeve 29 are maintained in position in relation to each other by two end pieces 31, 32.

The end piece 31 closes the adjacent ends of both the barrel 27 and the cylindrical sleeve 29.

The end piece 32 closes the adjacent end of the cylindrical sleeve 29 and has a central opening 33 which is aligned with the barrel 27. With this arrangement, the barrel 27 is open at its outer end to receive the shaft 15 of a spear 13, as will be explained in more detail later. The end piece 32 includes a sleeve portion 34 which is located about the central opening 33 and which guidingly supports the spear shaft 15.

Figure 3:
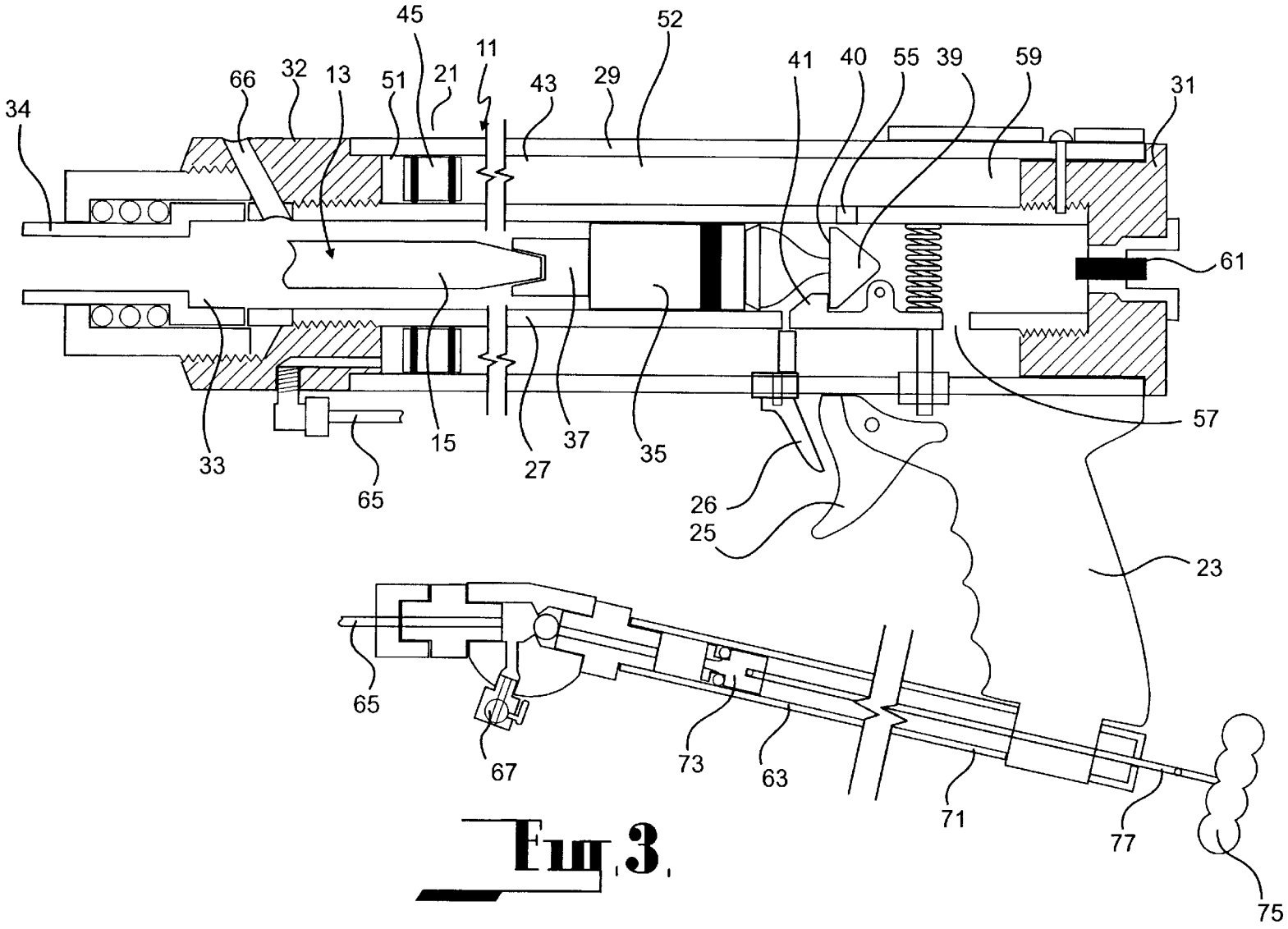
FIG. 3 is a view similar to FIG. 2, with the exception that the spear gun is shown in a condition in which the spear has been loaded.
Figure 4:
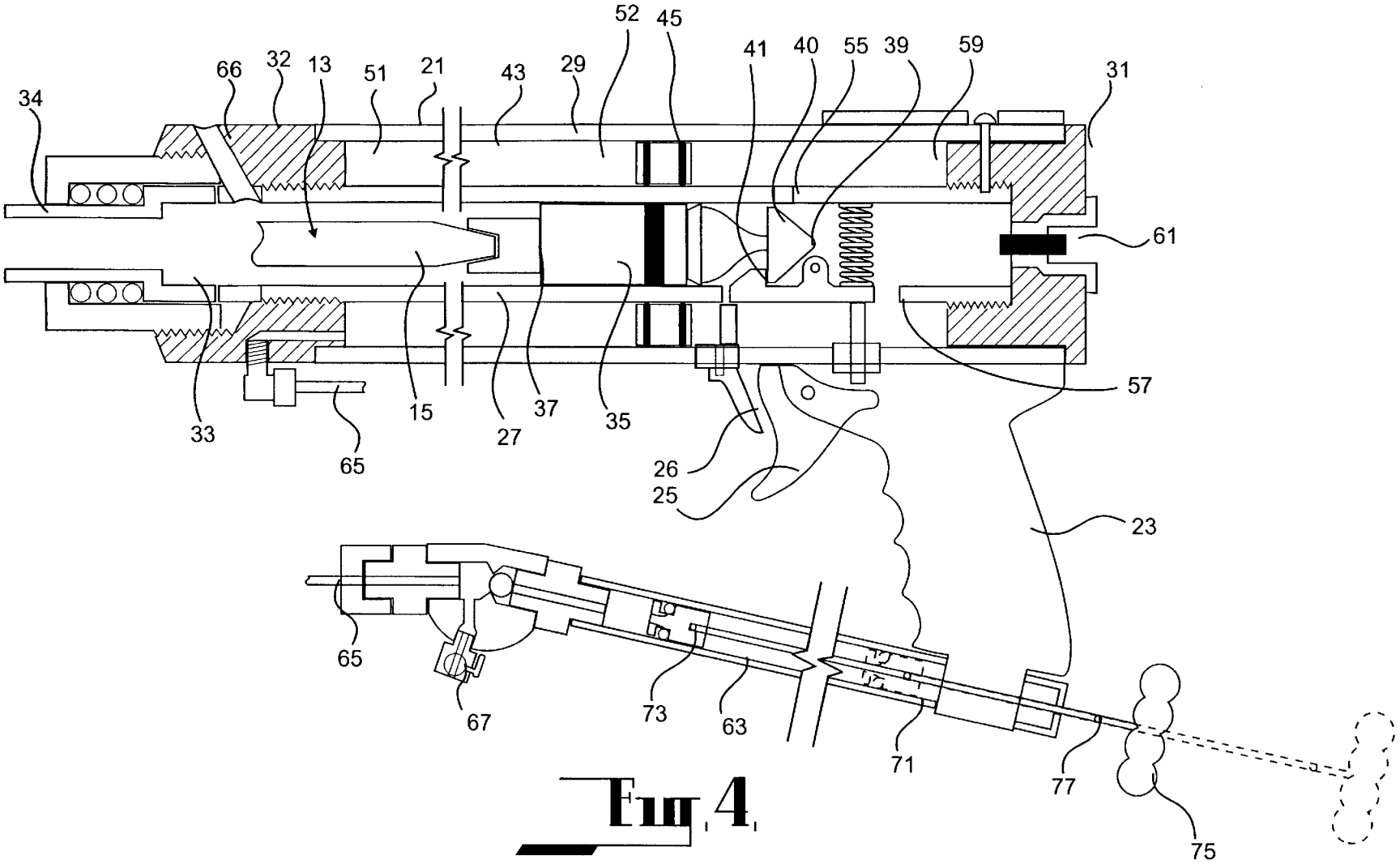
FIG. 4 is a view similar to FIG. 3 with the exception that a hand pump forming part of the spear gun is being operated to selectively increase the propulsive force applied to the spear when the spear gun is operated.

A first piston 35 is slidingly and sealingly received in the barrel 27. The piston 35 has a leading end 37 formed as a socket portion to receive the taper trailing end 17 of the shaft 15 of a spear 13. The piston 35 also has a trailing end 39 formed with an abutment 40 for engagement with a latch 41 forming part of the trigger mechanism 25. The piston 35 is movable along the barrel 27 towards and away from a retracted position in which it is engaged by the latch 41, as seen in FIGS. 3 and 4 of the drawings.

The spaced relationship between the barrel 27 and the cylindrical sleeve 29 defines a cylinder 43 of annular cross-section.

A second piston 45 is slidably and sealingly received in the cylinder 43 to divide that cylinder into two chambers, being a first chamber 51 and a second chamber 52, each of variable volume. The second chamber 52 communicates with the interior of the barrel 27 through ports 55 and 57 which are located in the barrel on the side of the piston 35 which is opposite the open end 33 of the barrel. With this arrangement, the chamber 52, together with the region within the barrel 27 with which it communicates, provides a reservoir 59 which contains a supply of air. The air can be introduced into the reservoir 59, and replenished as necessary, by way of a one-way inlet valve 61 provided in the end piece 31.

The first chamber 51 is adapted to receive water under pressure from a pump means 63 which is in the form of a hand pump. The hand pump 63 is mounted on the handle 23 and body 21 and is connected for flow communication with the chamber 51 by way of a flow line 65.

Operation of the hand pump 63 receives water taken from the underwater environment in which the spear gun is being used and delivers it to the chamber 51. Pumping of water into the chamber 51 causes the second piston 45 to move along the cylinder 52 and thereby reduce the volume of the second chamber 52 and consequently the reservoir 59.

Figure 2:
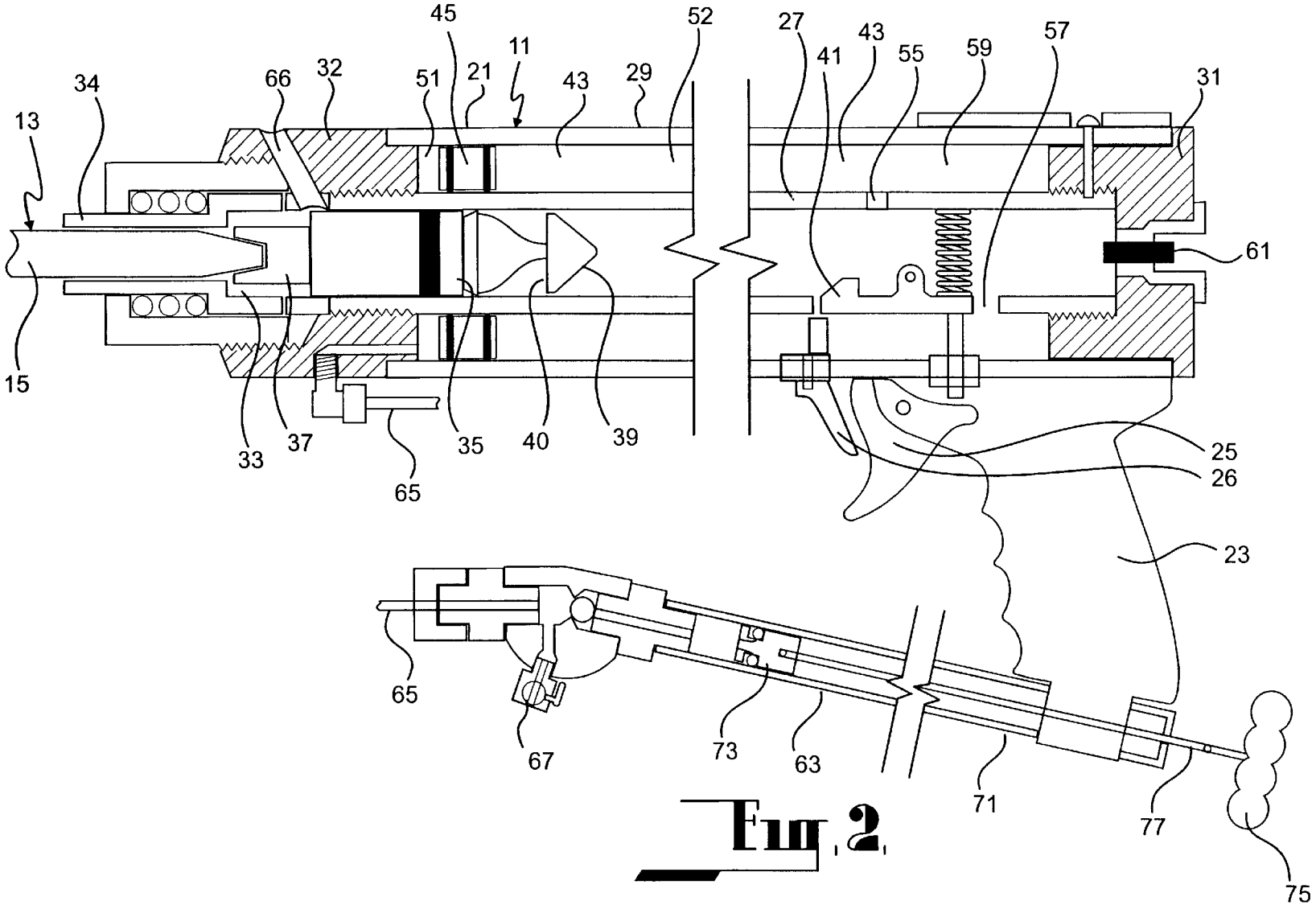
FIG. 2 is a fragmentary sectional elevational view of the spear gun shown in a condition at commencement of loading of a spear into the spear gun.

In operation of the spear gun, the shaft 15 of the spear 13 is inserted into the barrel 27 through the opened end 33 thereof so that the tapered end 17 of the spear engages in the piston 35, as shown in FIG. 2 of the drawings. At this stage, the reservoir 59 is at its maximum volume condition as water has not been delivered under pressure to the first chamber 51. As the shaft 15 of the spear 13 is pushed into the barrel, it forces the piston 35 inwardly towards a retracted condition in which it is engaged by the latch 41 of the trigger mechanism 25 and so retained in that position. The inward movement of the piston 35 causes the air within the reservoir 59 to be compressed, The compressed nature of the air provides a force on the piston 35 which, when the piston is released from its retracted position upon operation of the trigger mechanism 25, causes the piston to be propelled along the barrel and thereby propel the spear 13 from the spear gun 11. The force by which the piston 35 is propelled along the barrel (and consequently the force by which the spear 13 is propelled from the spear gun) is dependent on the force applied on the piston by the compressed air. This force can be increased by the user as required by operation of the hand pump 63. In this regard, operation of the hand pump 63 pumps water into the chamber 51 at a pressure higher than the air pressure within the reservoir 59. Consequently, the second piston 45 is caused to move along the annular cylinder 43, increasing the volume of the first chamber 51 and decreasing the volume of the second chamber 52 until such time as there is an equalization of pressure on opposed sides of the piston. The reduction in volume of the second chamber 52 provides a volume reduction in the reservoir 59 and consequently a volume reduction in the compressed air, This leads to an increase in the pressure of the compressed air and so an increase in the propulsive force applied to the first piston 35. Accordingly, the user can vary the propulsive force applied to the piston 35 by varying the quantity of water pumped into the first chamber 51.

Figure 5:
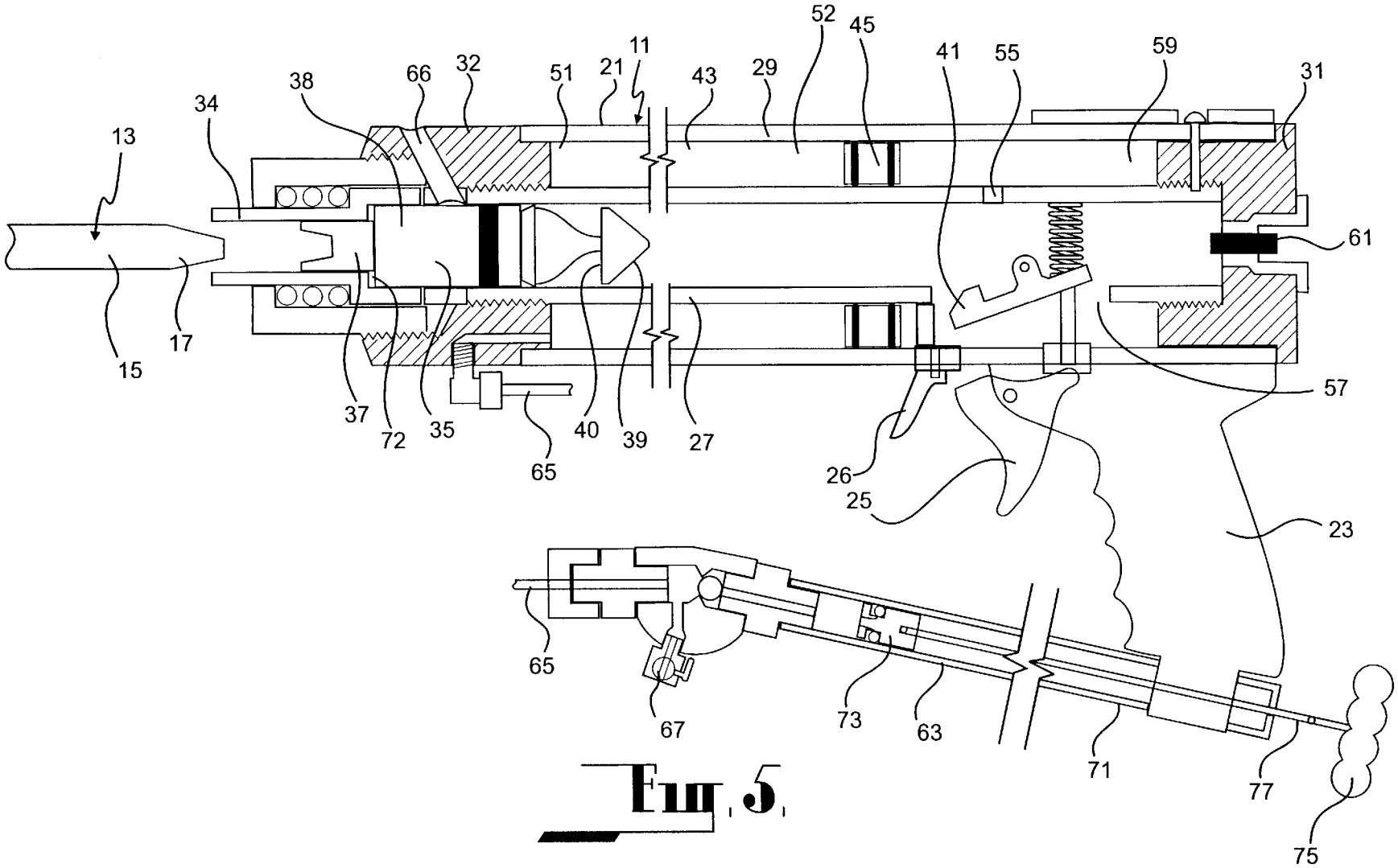
FIG. 5 is a fragmentary sectional view showing the spear gun propelling the spear.

Upon releasing trigger mechanism 25, the piston is propelled forwardly, as shown in FIG. 5 of the drawings.

Water in the barrel 27 ahead of the first piston discharges through a side discharge port 66 incorporated in the end piece 32.

The end piece 32 incorporates a system for cushioning the impact of the first piston 35 on the end piece 32 utilising a pocket of trapped water ahead of the side discharge port 66 as best seen in FIG. 5. With this arrangement, the discharge port 66 is at least partially closed by the intermediate section 38, of the piston 35 as the leading end 37 enters the opening 33 in the end piece 32. A space 72 therefore develops in the end piece 32 ahead of the piston 35. As the discharge port 66 is at least partially closed, a pocket of water is trapped in the space 72, serving to retard movement of the piston 35 and cushion the subsequent impact of the piston on the end piece 32.

The pump 63 incorporates a drain valve 67 by means of which water can be drained from the first chamber 51 after the spear gun has been fired. Typically, with the drain valve 67 open, water would be expelled by rearward movement of the piston 45 under the influence of air pressure in the reservoir 59. The drain valve 67 would need to be closed before the pump 63 can be operated to again deliver water to the first chamber 51.

The pump 63 is in the form of a piston pump having a suction stroke and a delivery stroke. The pump has a pump cylinder 71 in which a pump piston 73 is slidably and sealingly engaged. The pump cylinder 71 and pump piston 73 co-operate to define a pumping chamber 74. The pump piston 73 is connected to a handle 75 by way of an actuating rod 77 which extends beyond one end of the cylinder 71.

The pump piston 73 incorporates a circumferential recess 79 which accommodates a sealing element 81 in the form of an O-ring. The O-ring 81 provides the sliding and sealing engagement between the piston 73 and the cylinder 71.

Figure 6:
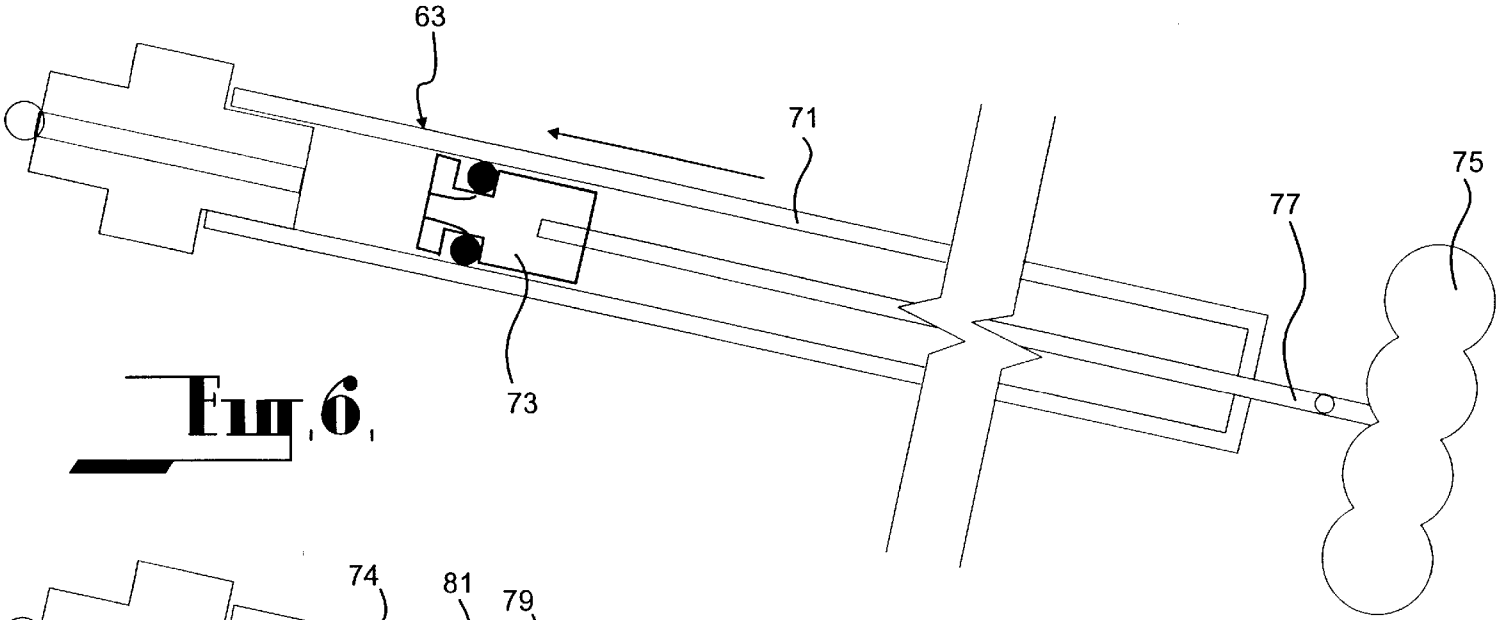
FIG. 6 is a schematic view of the hand pump performing a delivery stroke.
Figure 7:
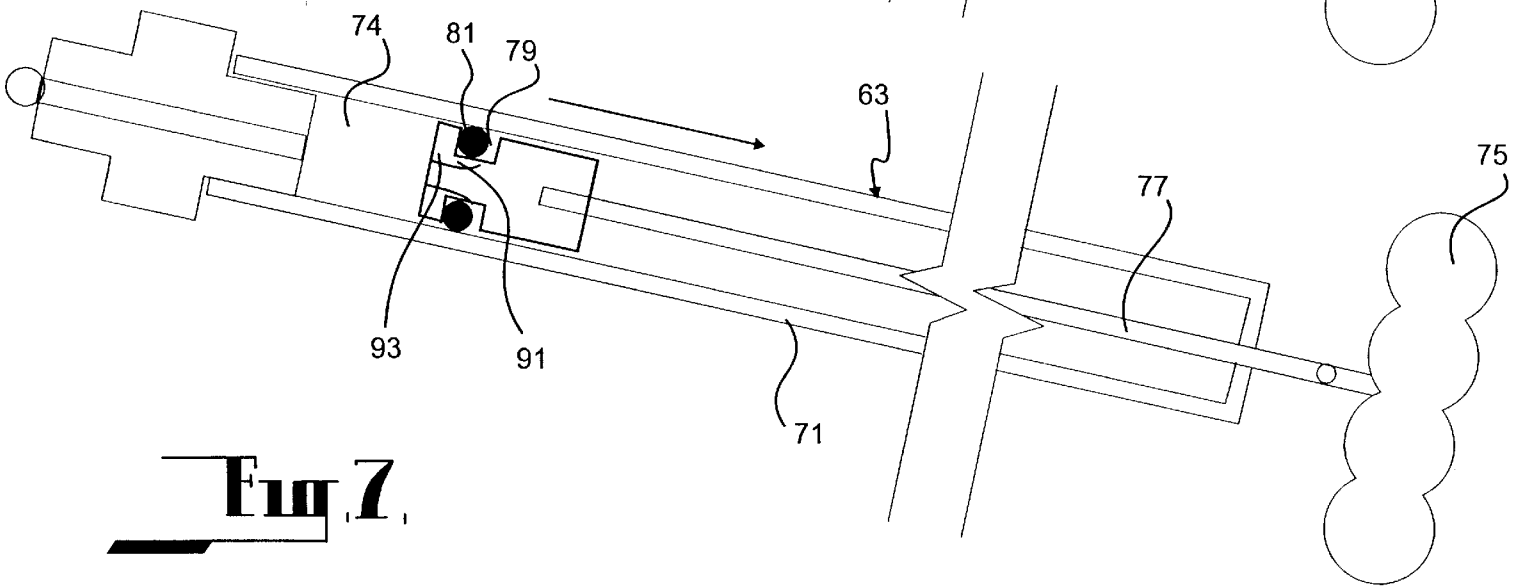
FIG. 7 is a schematic view of the hand pump performing an intake stroke.

The recess 79 is of a width greater than the O-ring 81 such that the O-ring 81 can move axially within the recess between first and second positions upon reciprocatory movement of the pump piston 73 in the pump cylinder 71 The O-ring 81 assumes the first position when the pump 63 performs a suction stroke, as illustrated in FIG. 7 of the drawings. The O-ring assumes the second position when the pump 63 performs a delivery stroke, as illustrated in FIG. 6 of the drawings. In the second condition in which the O-ring 81 assumes during a delivery stroke of the pump, the O-ring 81 seals against fluid flow past the piston. In the suction stroke as illustrated in FIG. 7 of the drawings, an in-take path 91 is provided along which water can flow past the piston 73 and into the pumping chamber 74. The intake path 91 is provided with a plurality of radial slits 93 formed in the piston 73 and extending between the recess 79 to the end of the piston which faces the pumping chamber 74. With this arrangement, water can by-pass the O-ring 81 by flowing along the slits 93 and into the pumping chamber 74 upon an intake stroke of the piston. On a subsequent delivery stroke, the O-ring moves into the second condition in which it is clear of the slits 93 to therefore maintains integrity of sealing.

From the foregoing, it is evident that the present invention provides a simple yet highly effective arrangement for selectively increasing the propulsive force which can be applied to a spear propelled by the spear gun.

It should be appreciated that the scope of the invention is not limited to the scope of the embodiment described.

Throughout the specification, unless the context requires otherwise, the word "comprise" or variations such as "comprises" or "comprising", will be understood to imply the inclusion of a stated integer or group of integers but not the exclusion of any other integer or group of integers.

What is claimed is:

1. A method of changing the propulsive force of a projectile of a spear gun comprising the steps of:

providing a compressible fluid in a compressible fluid reservoir in the spear gun, wherein the compressible fluid produces a propulsive force to propel the projectile from the spear gun;

inserting the projectile into the spear gun until a piston for receiving the projectile reaches a fully retracted position; and moving a movable wall in the spear gun in order to change the volume of the reservoir, wherein the change in the volume of the reservoir changes the propulsive force on the projectile by changing the pressure of the compressible fluid inside the reservoir.

2. The method of changing the propulsive force of a projectile of a spear gun of claim 1, wherein the projectile is a spear.

3. The method of changing the propulsive force of a projectile of a spear gun of claim 1, wherein the step of moving a movable wall in the spear gun in order to change the volume of the reservoir includes the step of:

moving the movable wall so as to decrease the volume of the reservoir and increase the propulsive force on the projectile by increasing the pressure of the compressible fluid inside the reservoir.

4. The method of changing the propulsive force of a projectile of a spear gun of claim 1 further comprising the steps of:

providing the movable wall with a first end in contact with the compressible fluid, and a second opposing end in contact with an incompressible fluid;

pumping the incompressible fluid into a chamber defined in part by the second opposing end of the movable wall; and moving the movable wall in a direction that reduces the volume of the compressible fluid reservoir, wherein the movable wall will move until the pressure is equal on the first end and second end of the wall.

5. The method of changing the propulsive force of a projectile of a spear gun of claim 4, wherein the incompressible fluid is water.

6. A spear gun comprising a barrel having an open end through which a shaft of a spear can be received, a first piston slidingly and sealingly received in the barrel for movement towards and away from a retracted position, a retaining means for releasably retaining the piston in the retracted position, a compressible fluid arranged to undergo compression upon movement of the piston into the retracted position and to propel the piston along the barrel from the retracted position upon release of the piston thereby to propel the spear, and control means for selectively changing the pressure of the compressible fluid to vary the propulsive force applied to the piston, wherein said control means comprises a moveable wall for effecting a change in the volume of said compressible fluid when the piston is retained in the retracted position.

7. A spear gun according to claim 1 wherein the compressible fluid is air.

8. A spear gun according to claim 1 wherein the reservoir comprises a cylinder having a second piston slidingly and sealingly mounted therein to define the movable wall, one side of the second piston being exposed to the compressible fluid whereby movement of the second piston along the cylinder effects a variation of the volume of the reservoir, and wherein a second control means is provided for controlling movement of the second piston along the cylinder.

9. A spear gun according to claim 8 wherein the second control means comprises means for applying fluid pressure to the other side of the second piston.

10. A spear gun according to claim 9 wherein the second control means comprises a pump means for delivering the fluid pressure by way of an incompressible fluid.

11. A spear gun according to claim 10 wherein the incompressible fluid comprises water received from an underwater environment in which the spear gun is being used.

12. A spear gun according to claim 10 wherein the pump means comprises a hand operable pump.

13. A spear gun according to claim 8 wherein the cylinder is of annular configuration in cross-section and positioned around at least part of the barrel, with porting means providing for communication of the compressible fluid between the cylinder and the barrel.

14. A spear gun according to claim 10 wherein the pump means comprises a piston pump having a suction stroke and a delivery stroke.

15. A spear gun according to claim 14 wherein the piston pump comprises a pump piston slidingly and sealingly mounted in a pump cylinder, the pump piston and pump cylinder co-operating to define a pumping chamber, the pump piston including a sealing element movable axially between a first position and a second position upon a reciprocatory movement of the pump piston in the pump cylinder whereby upon a suction stroke of the piston the sealing element assumes the first position in which fluid can flow past the piston into the pumping chamber and upon a delivery stroke of the piston the sealing element assumes the second position in which the sealing element seals against fluid flow past the piston.

16. A spear gun according to claim 15 wherein intake path is provided in the piston along which fluid can flow when the sealing element is in the first position.

17. The spear gun of claim 1, wherein said control means is operative for selectively increasing the pressure of the compressible fluid to increase the propulsive force applied to the piston by increasing the pressure of the compressible fluid.

* * * * *